United States Patent [19]

van der Meer et al.

[11] Patent Number: 4,597,200

[45] Date of Patent: Jul. 1, 1986

[54] DETACHABLE COUPLING FOR A SUCTION HEAD

[75] Inventors: Paulus van der Meer, Zevenhuizen; Jan P. Koert, Nieuw Lekkerland, both of Netherlands

[73] Assignee: IHC Holland N.V., Papendrecht, Netherlands

[21] Appl. No.: 666,219

[22] Filed: Oct. 29, 1984

[30] Foreign Application Priority Data

Oct. 28, 1983 [NL] Netherlands ..... 8303725

[51] Int. Cl.[4] ..... E02F 3/92

[52] U.S. Cl. ..... 37/63; 37/58; 37/72; 285/421; 403/374; 403/409.1

[58] Field of Search ..... 37/58, 62, 63, 72; 403/374, 409, 407, 405; 172/272; 414/723; 285/421

[56] References Cited

U.S. PATENT DOCUMENTS

| | | | |
|---|---|---|---|
| 366,468 | 7/1887 | Edwards et al. | 37/63 |
| 399,251 | 3/1889 | Edwards | 37/58 |
| 1,182,610 | 5/1916 | Wiesman | 403/407 |
| 1,840,606 | 1/1932 | Scheffauer | 37/58 |
| 1,885,326 | 11/1932 | Brune . | |
| 2,152,891 | 4/1939 | Kohnke | 403/409 X |
| 2,339,128 | 1/1944 | Younie . | |
| 3,493,272 | 2/1970 | Sylvester et al. | 403/374 X |
| 3,589,755 | 6/1971 | King | 403/407 X |
| 3,975,842 | 8/1976 | Andreae . | |
| 4,113,029 | 9/1978 | Ramsower | 172/272 |
| 4,150,502 | 4/1979 | Sijthoff | 37/58 |
| 4,265,035 | 5/1981 | Goedvolk . | |

FOREIGN PATENT DOCUMENTS

| | | |
|---|---|---|
| 7314168 | 4/1975 | Netherlands . |
| 7714438 | 6/1979 | Netherlands . |
| 8005126 | 12/1980 | Netherlands . |
| 8006053 | 6/1982 | Netherlands . |

*Primary Examiner*—Clifford D. Crowder
*Attorney, Agent, or Firm*—Young & Thompson

[57] ABSTRACT

Suction pipe with trailing head for a trailing suction dredger, the pipe being provided at its lower end with a connection piece of the trailing head in which the essentially rectangular throughflow opening of the trailing head passes into the circular cross section of the pipe. A replaceable endpiece or trailing head part, which forms the suction aperture or suction slit, is or can be detachably fixed at the side facing the connection piece by a quick action coupling to the connection piece in such a way that it rotates about a horizontal cross-shaft.

6 Claims, 17 Drawing Figures

DETACHABLE COUPLING FOR A SUCTION HEAD

The invention relates to a suction pipe with trailing head for a trailing suction dredger, said pipe being provided at its lower end with a connection piece of the trailing head in which the essentially rectangular throughflow opening of the trailing head passes into the circular cross section of the pipe, said connection piece having connected to it a receptacle endpiece or trailing head part which forms the suction aperture or suction slit and is fixed on the connection piece in such a way that it rotates about a horizontal cross-shaft.

Such a suction pipe is known in practice. This generally known suction head consists of a connection piece which is fixed on the suction pipe and can be combined with a suitable type of endpiece. By combining a single connection piece with various endpieces, it is possible to adapt to the requirements of the customer without having to produce a totally different trailing head for each purpose. The attachment of the endpiece to the connection piece in such a way that the endpiece can swivel to a limited extent in relation to the connection piece around the hinge pins is essentially a permanent attachment.

If one wishes to replace with another endpiece the endpiece attached to the connection piece, something which does occur in practice and is also recommended by the suppliers, then the welded joint has to be broken in order to permit removal of the hinge pins, following which the endpiece can be replaced by another one. This is a complicated and lengthy process which takes several days, which pales into insignificance compared with the fact that one also has to loosen the seals gripping the cylindrical upper face and the side faces of the endpiece.

The object of the invention is to produce a suction pipe with trailing head, with which it is possible to change the endpiece very quickly for another endpiece or trailing head part in such a way that the endpiece can be changed in the relatively short time which is available when the trailing suction dredger is sailing from the dredging point to the unloading point and back, a period during which the suction pipe can be lifted on board.

This object is achieved according to the invention by the endpiece being attached or attachable in disconnectable fashion to the connection piece at the end facing the connection piece by means of a quick action coupling. Since according to the invention the endpiece is connected in one or another suitable fashion with the connection piece so that it is quickly detachable and replaceable, one can quickly remove a hinge fastened to the connection piece and replace it by another endpiece, provided that the coupling devices of the different endpieces are identical to one another and fit on those of the connection piece. As regards the design of the quick detachable coupling, the expert can choose from many possibilities such as wedges, bolts, cross bars etc. The point of division between endpiece and connection piece can also be designed in different ways.

In the known trailing head the hingeing facility of the endpiece with the connection piece is obtained by means of two short hinge pins placed on either side of the trailing head, said hinge pins being secured in the known trailing head by means of a welded joint.

According to the invention, it is now possible for the hinge pins to be attached to the endpiece and project into bearing housings which are attached to the connection piece by means of quick action couplings. Each endpiece therefore has pins and bearings housings and is fixed with these bearing housings on the connection piece. The bearings are therefore also found on an endpiece which is not in use, which facilitates the maintenance of the bearings. With this type, the connection piece can be provided with recesses open at the top and closed at the bottom on either side of the bottom edge of the inflow opening of the connection piece, said recesses having guide planes for slidably receiving the respective bearing housings in the recesses, and means are provided for fixing the bearing housings in the recesses. These means can be formed by a wedge, which can be provided between an upward-running face of the bearing housing and a groove in the opposite guide plane of the recess. These bearing housings can be trapezoidal in side view and fit into correspondingly shaped recesses of the connection piece, and the wedge, instead of being provided between an upward-running face of the bearing housing and a groove in the opposite guide plane of the recesses, can also be provided in such a way that it runs over the base plane of the trapezoidal bearing housing and thereby projects through apertures of the connection piece situated at a distance from one another.

According to another type, the hinge pins can be provided so that they are quickly detachable and removable in the transverse direction. This is the simplest embodiment, for the replaceability is based solely on removal crosswise of the hinge pins or the placing thereof when the apertures of the connection piece and endpiece are brought into line with one another. The hinge pins can here be provided with a recess or groove into which projects a wedge which is closed by faces of one of the parts which pivot in relation to each other, such as the connection piece. This wedge secures the hinge pin in the axial direction and is not loaded by the forces occurring between endpiece and connection piece.

According to a third possibility, the hinge pins can be firmly attached to one of the parts which pivot in relation to each other, such as to the endpiece, and the other part can have a divisible bearing housing which can be closed by means of a quick securing device. The divisibility is therefore obtained here at the bearing housing itself, which permits not only rapid fitting and removal, but also inspection of the bearings.

This divisible bearing housing can consist of a fixed part and a cap which is hinged on the fixed part and can be secured on the fixed part by means of a wedge. The divisible bearing housing can also consist of a fixed part with a nesting groove which is open at the top, and of which the semi-cylindrical lower surface forms part of the bearing, and of a fork which is rotatably mounted in the fixed part and has between its legs a semi-cylindrical bearing face, said fork being mounted to rotate about the central axis of the bearing and being swivellable from a position in which the opening of the nesting groove and of the fork run in the same direction to a position in which the fork closes the opening of groove and vice versa, and the fork can be fixed in the closed position. In divided bearings the endpiece with the hinge pins attached to it can be placed easily and quickly in the open bearings and secured there by closing the bearings, either by swinging the cap into the closed position or by swinging the fork into the closed position.

Finally, it is also possible to attach the hinge pins in a non-detachable manner in the connection piece and provide the hinge pins with arms on which the endpiece can be fixed by means of a quick action coupling.

In the known trailing head mentioned earlier, the endpiece has a cylindrically curved upper face which works in conjunction with a flexible sealing strip, which is attached to the connection piece by means of an upward-running flange and fixing bolts. According to the invention, this sealing strip is attached here in a swing-away manner. If an endpiece has to be changed, the sealing strip can therefore be fully swung away in order further to facilitate removal and fitting. In the operating position, no additional provisions are necessary, since the sealing strip is pulled against the arched upper face through the partial vacuum in the trailing head.

According to the invention, it is also preferable for the connection piece to be provided under the lower edge of the throughflow opening with a tool carrier which extends transversely over the width of the trailing head. In this way, one obtains a distribution of the functions. The tools no longer rest on the endpiece—as, for example, in the case of an endpiece of the "California type"—but on the connection piece. The replaceable endpiece consequently is considerably lighter and is thus easier to handle during removal and fitting.

It is also preferable to provide the tool carrier with quick action couplings for attaching tools such as cutting knives in such a way that they can be changed. This produces the possibility of making the trailing head work with or without tools, and it is easy to change tools in the case of wear or for changing the type of tool, for example as soon as the endpiece is removed.

Each tool can be fixed to the tool carrier via an arm which at the end which is to be fixed to the tool carrier forms part of the quick action coupling, and to which the tool is attached via a hinge pin and a shearing pin some distance away from it.

In the known trailing head mentioned earlier, the connection piece consists of two parts which are connected to each other via a shearing division, which means that the two parts have a hinge pin at the top end and are connected to each other near the bottom edge by shearing pins. If overloading occurs, these pins break and the lower part of the connection piece with the endpiece attached to it swings away. Linking each tool individually to the tool carrier via a shearing safety device, according to the invention, means that if one of the tools is overloaded, the remainder continue to function, so that the proposed trailing run can be completed without the dredging having to be interrupted. Repair is possible by replacing the shearing pin or by changing the tool if the latter needs replacing as a result of the overloading and despite the safety device.

According to the invention, the quick action coupling can consist of a trapezoidal wedge plate which can be locked in the spaces between two guides which run downwards toward each other, and which with their flanged edges facing each other can grip the sloping side of the trapezoidal plate and can lock the latter, and which are attached on a downward-running rear face of the tool carrier.

With this simple wedge plate attachment, rapid fitting and removal of tools is possible.

The known trailing head described above is provided on the underside of the connection piece with a slipper. This known trailing head can also be provided with a pressure water infeed for spray nozzles.

An efficient construction is obtained according to the invention if the tool carrier forms the rear wall of a water tank which is connected to a pressure water pipe and is located between the slipper and the bottom wall of the throughflow channel in the connection piece, and the tool carrier contains spray nozzles which are connected with the water tank.

These spray nozzles can be lockable if desired.

In the known trailing head, the pressure water infeed is connected to the side of the connection piece.

According to the invention, the pressure water pipe can run through the middle part of the connection piece and in the throughflow channel be perpendicular to the direction of throughflow and there be provided on either side of the throughflow channel with flow guide plates. This gives a uniform feed of water to the spray nozzles, and the change in the throughflow cross section of the connection piece thereby obtained can be used to control the rate of throughflow in the correct manner.

In the known trailing head mentioned above, the endpiece is provided with a water inflow valve in the upper surface near the rear edge of the endpiece. This valve pivots about a transverse shaft situated on the rear edge of the valve. When the valve is open, eddies occur above the endpiece and cause energy losses. According to the invention, it is preferable to place the shaft on the front edge of the valve, so that in a more or less open position it permits an inflow which is directed towards the inflow aperture of the connection piece and thereby exerts a better eroding action on the earth which is to be loosened.

The invention will now be explained in greater detail with reference to the drawings.

FIGS. *3a–3d* are side views of different endpieces which can be connected to the connection piece.

Figure 4:
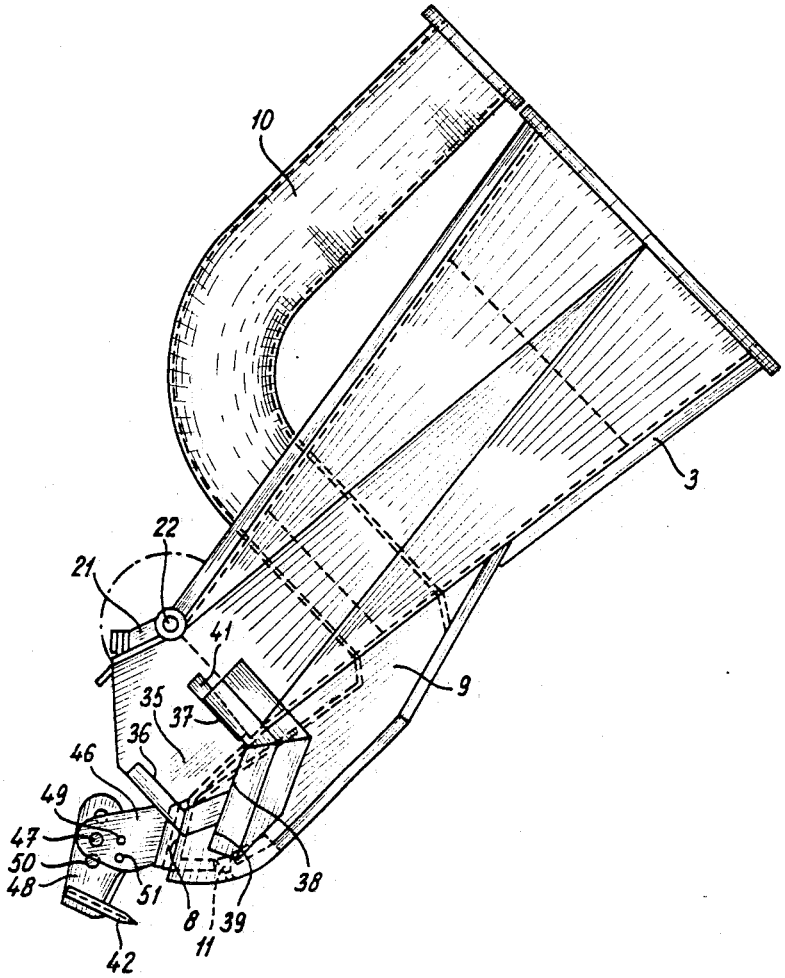

FIG. 4 is a side view of the connection piece.

Figure 5:
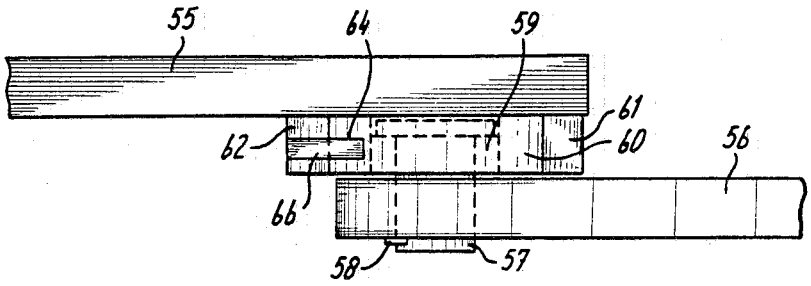

FIG. 5 is a schematic top view of a variant of the attachment according to the previous figures.

Figure 6:
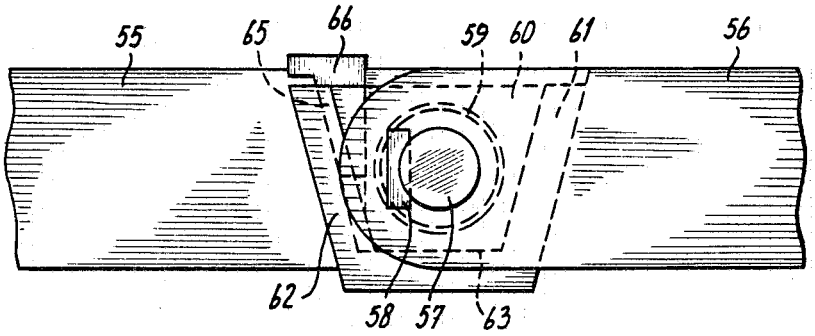

FIG. 6 is a side view of FIG. 5.

Figure 7:
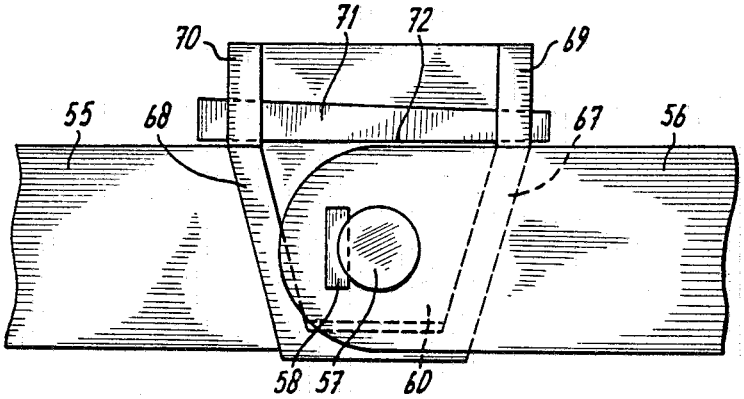

FIG. 7 is a variant of the embodiment of FIGS. 5 and 6.

Figure 8:
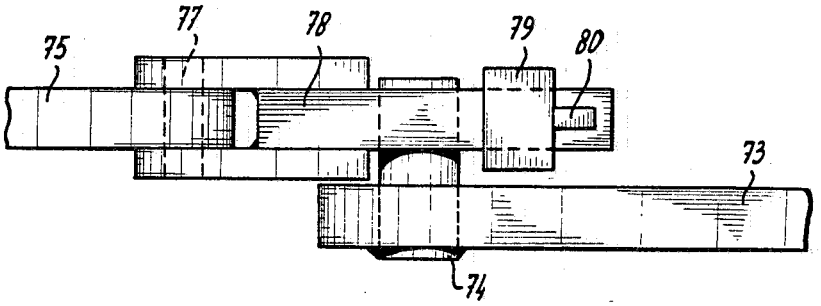

FIG. 8 is a top view of another connection possibility.

Figure 9:
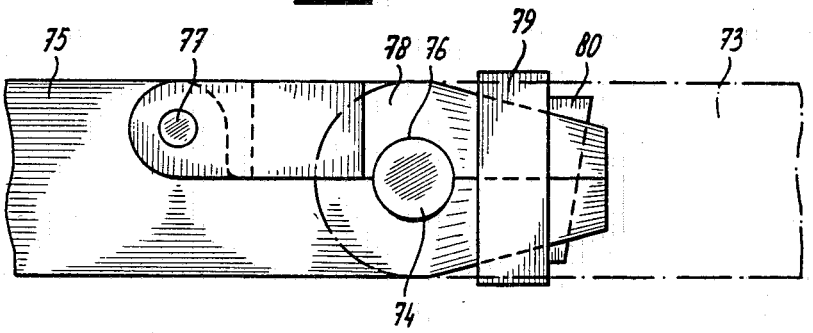

FIG. 9 is a side view of FIG. 8.

Figure 10:
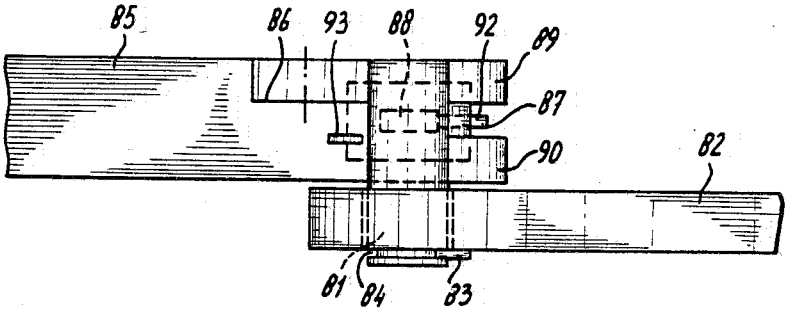

FIG. 10 is a top view of another embodiment of the connection possibility.

Figure 11:
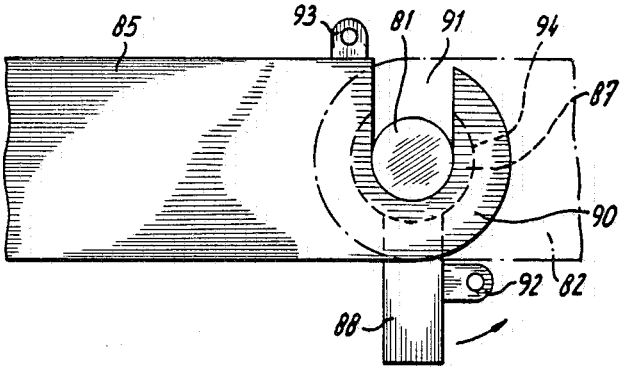

FIG. 11 is a side view of FIG. 10 and

Figure 12:
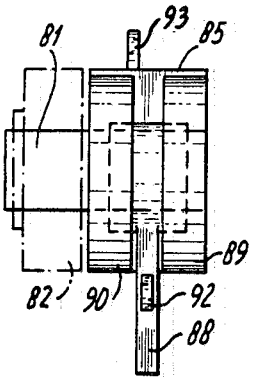

FIG. 12 is an end view of FIG. 11.

Figure 13:
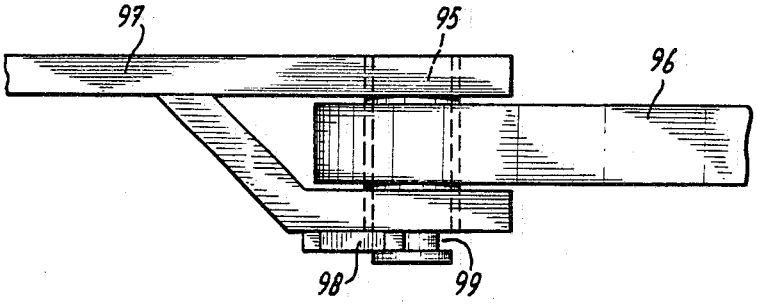

FIG. 13 is a schematic top view and

Figure 14:
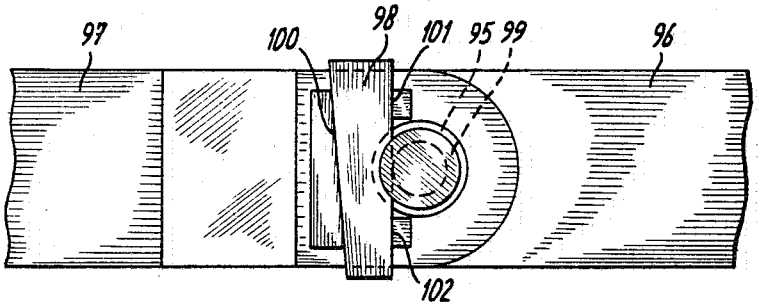

FIG. 14 is a side view of another embodiment.

Figure 15:
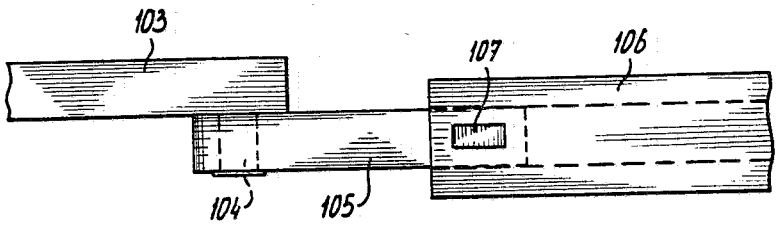

FIG. 15 is a schematic top view of another embodiment.

Figure 16:
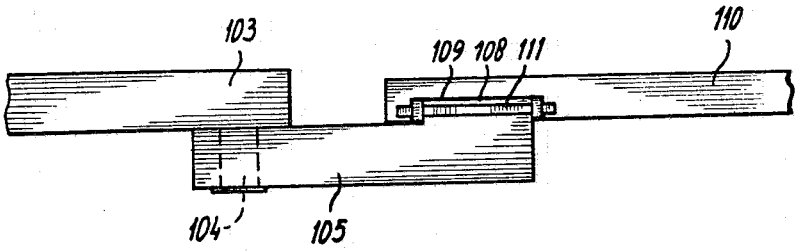

FIG. 16 is a top view of yet another embodiment and

Figure 17:
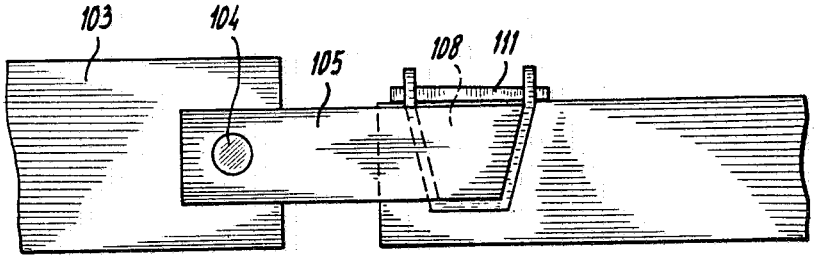

FIG. 17 is a side view of FIG. 16.

Figure 1:
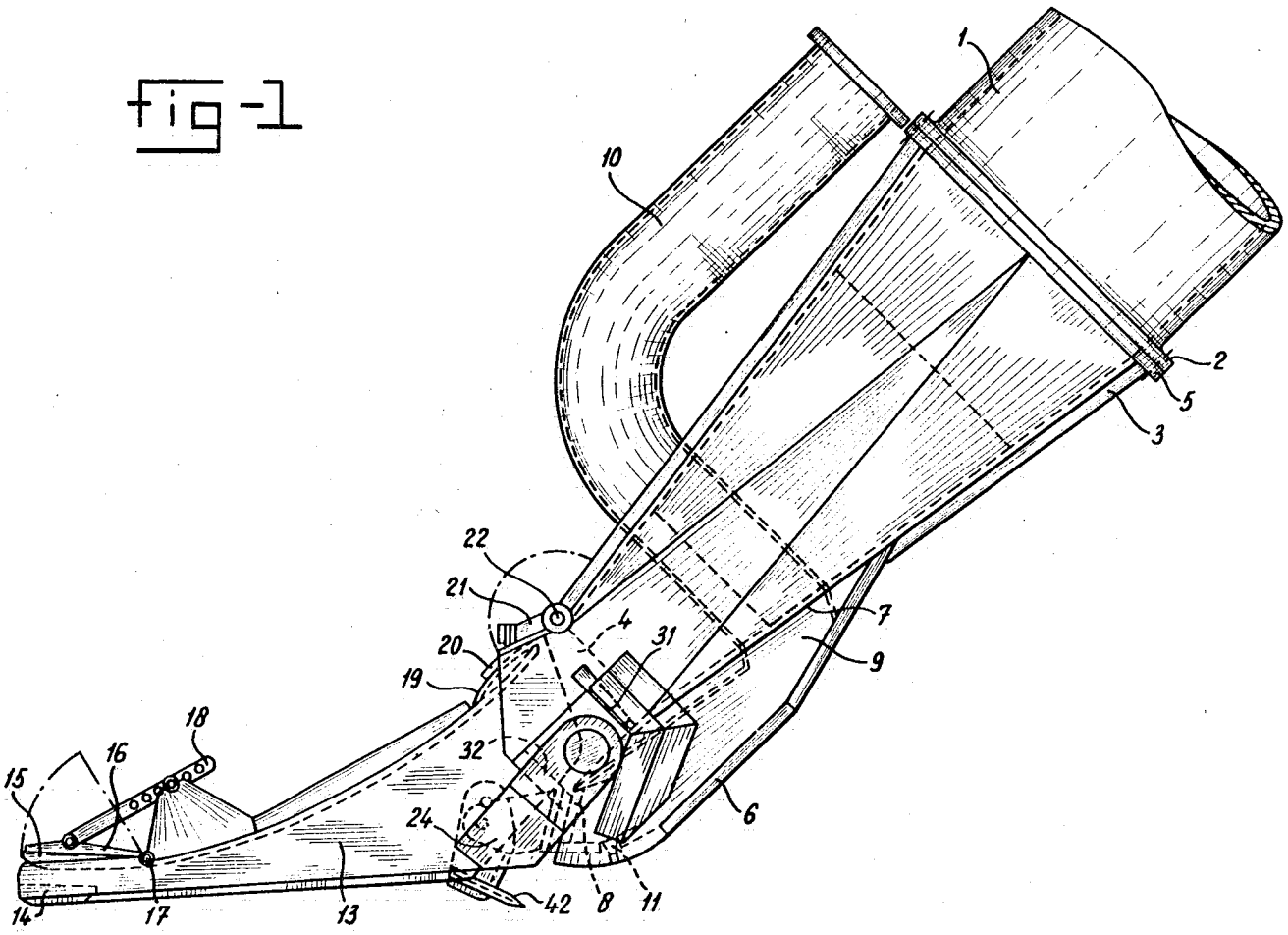
FIG. 1 is a side view of the suction pipe with trailing head according to the invention.

FIG. 1 shows the lower end of a suction pipe 1 with a flange 2, to which is connected the connection piece 3, which at the inlet cross section 4 has a rectangular cross section and at the flange 5 attached to the flange 2 has a circular cross section corresponding to the cross section of the pipe 1.

Fitted to the underside of the connection piece is a slipper 6, which with the lower wall 7 of the throughflow channel of the connection channel 3 and with the side walls and rear wall 8 forms a water tank 9 to which a pressure water pipe 10 is connected. This water tank has in the under end of the slipper 6 water outflow nozzles 11, which are known per se. The rear wall 8, which also has the function of a tool carrier, can be provided with water outflow openings 12.

Attached to the connection piece is an endpiece 13, which at the rear wall at 14 has a slipper and which at 15 is provided with a water inflow aperture with a valve 16 which pivots about the front shaft 17 and in a desired open position can be fixed with the aid of the strip 18 which is provided with apertures.

This valve can, of course, also be provided with a remote-controlled mechanism which on the basis of the measurement values occurring in the suction pipe controls the position of the valve.

The top face of the endpiece 13 is cylindrically curved at 19 and on it rests a flexible sealing strip, for example a rubber strip 20, which is fixed on one or more arms 21 which can pivot about the shaft 22. The seal 20 can thereby be swung forwards and upwards.

Figure 2:
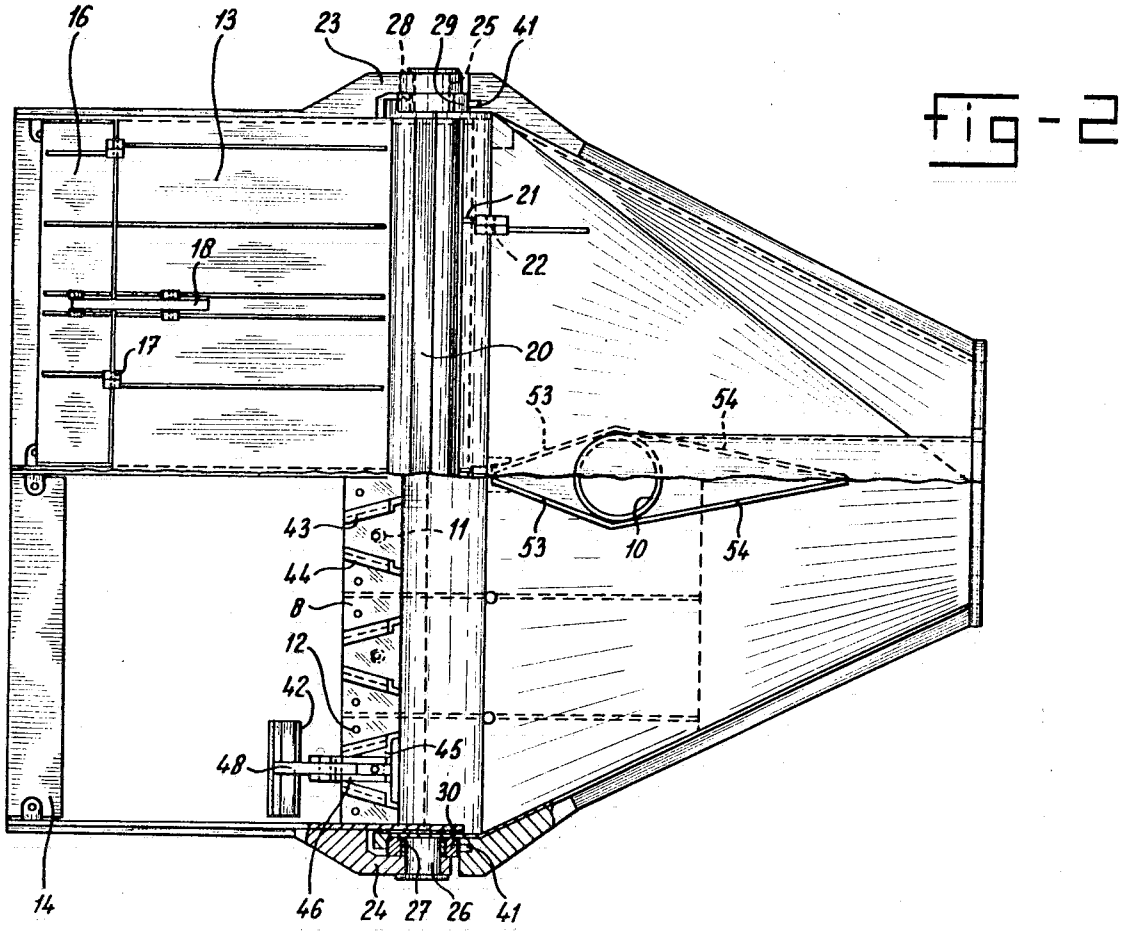
FIG. 2 is a top view of the trailing head according to FIG. 1, with part of the top surface of the endpiece left away.

The pivoting attachment of the hinge can be seen most clearly in FIG. 2. The endpiece 13 is provided on both side edges with arms 23, 24 which point forwards and in which short hinge pins 25, 26 are attached and project into bearings 27, 28 of a bearing housing 29 and 30.

Figure 3:
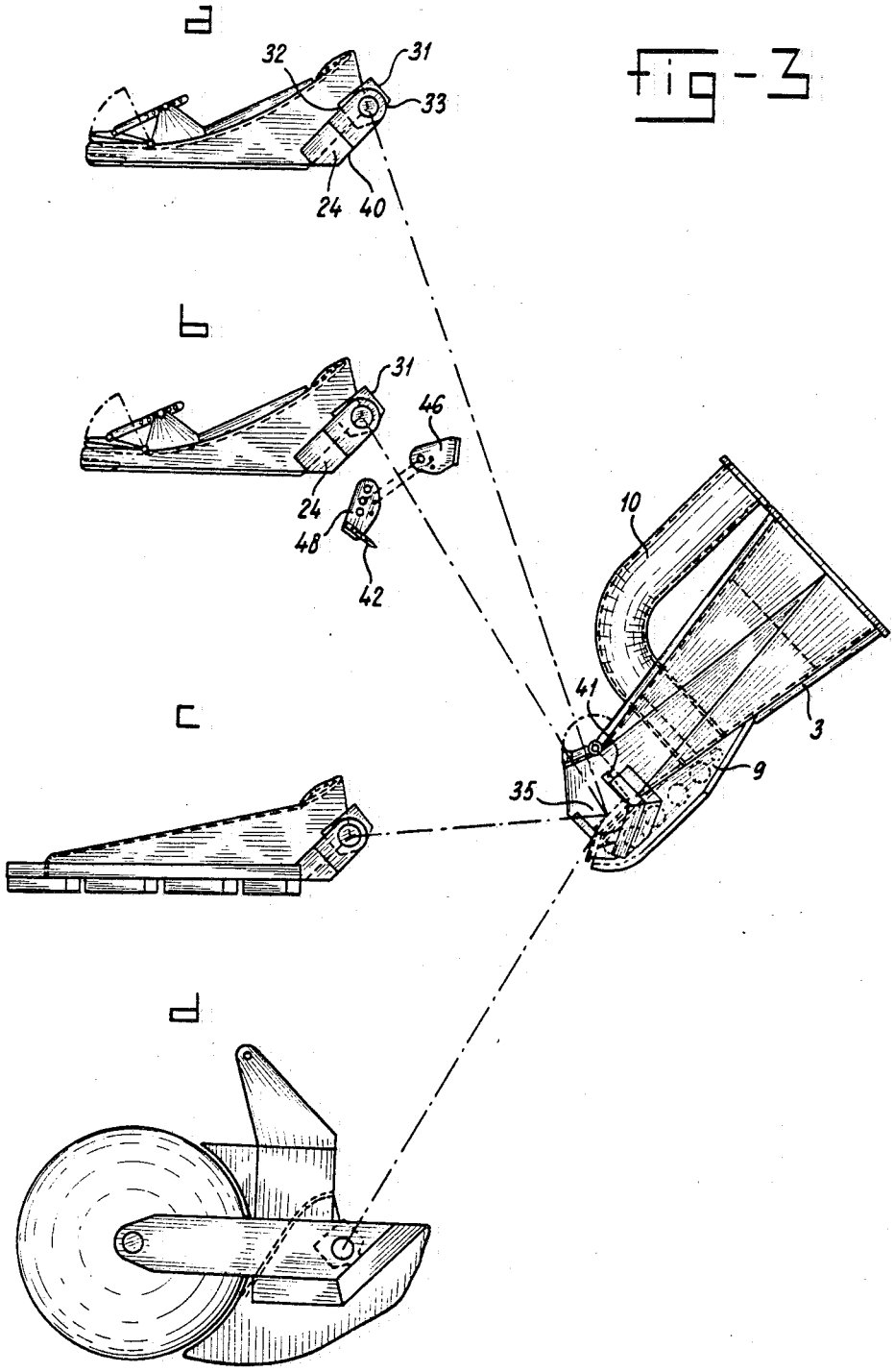

As shown in FIGS. 1 and 3, these bearing housings have parallel front and rear faces 31 and 32, and a V-shaped underface 33.

The connection piece is provided at the lower edge with recesses 35 with guide faces 36 and 37 (see FIG. 4).

These recesses also have a V-shaped bottom 38 which also at 39 has an extension which forms the stop face for the endpiece for the purpose of limiting the downward swing movement. These extensions 39 work in conjunction with the underfaces 40 of the arms 23 and 24 shown in FIG. 3.

In the frontmost guide face 31 there is a groove in which a wedge 41 is placed, by means of which the bearing housings 29, 30 can be fixed in the recesses 35.

It will be clear with this design an endpiece can very quickly be replaced by another endpiece. One merely has to remove the wedge 41 and flip over the seal 20, 21, and the endpiece can be pushed with the bearing housings up out of the guides 36, 37, following which another endpiece can then be fitted.

FIG. 3 shows a number of possibilities.

FIG. 3*a* shows a trailing head for loosely packed sand.

FIG. 3*b* shows the same trailing head as that in FIG. 3*a*, but this time combined with several knives 42, which will be described in greater detail below.

FIG. 3*c* shows a "California-type" endpiece, suitable for hard-packed sand.

FIG. 3*d* shows a trailing head with a kneading roll suitable for sucking up sludge.

As shown, all these heads can be provided with the bearing housings described above, with which they can be attached in the recesses 35 of the connection piece 3.

FIGS. 2 and 4 show that the rear wall 8 of the water tank 9 can be designed as a tool carrier.

Attached to this tool carrier are L-shaped strips 43, 44, which run downward in a V-shape to the downward-sloping rear face 8 which forms the tool carrier. Between these L-shaped strips 43, 44, one can position a trapezoidal plate 45, which has an arm 46 formed by two strips. This arm 46 formed by two strips has a bore 47 in the two strips, and between the two strips there is an arm 48 in which the knife 42 is located. The attachment is by means of a hinge pin in the bores 47 and a shearing pin 49.

As shown in FIG. 4, the strip 48 can have several holes 50 for the hinge pin which goes through the bores 47, and several holes 51 for the shearing pin. In this way, the knife can be placed in various positions, or adaptation to several tools is possible.

The above-mentioned nozzles are shown at 12, and 11 shows apertures in the tool carrier 8 which are also connected to the water tank 9. In the same way as in the carrier of the knife 42, one now can place between the strips 43 a trapezoidal holder plate with a jet nozzle.

The nozzles 12 are located between the tools. It is also possible to fit between the attachment strips 43, 44 water infeed apertures which can be connected to a passage of a channel of a tool.

As shown in FIGS. 1 and 2, the water pipe 10 runs transversely through the throughflow channel of the connection piece 3. On either side of the water pipe section found within this throughflow channel, there are current conducting plates 53, 54.

FIGS. 5 to 17 are schematic views of a number of variants indicating how the quickly detachable connection can be produced.

For instance, FIGS. 5 and 6 show at 55 a part of the connection piece and at 56 a part of the endpiece. The hinge pin 57, of which there is one fitted at each side of the trailing head, is fixed in the endpiece arm 56 by means of a wedge 58, and is rotatably mounted in a bearing 59 which is located in a bearing housing 60. As can be seen from FIG. 6, this bearing housing is trapezoidal and with the sloping sides of the trapezium fits into the correspondingly shaped recess of the connection piece, said recess being bounded by the side walls 61, 62 and the bottom part 63. The housing 60 has a groove 64, and the side wall 62 of the recess has a groove 65; the bearing housing 60 is fixed in the recess by means of a wedge 66 engaging with the grooves 64 and 65. This construction corresponds to a large degree to the construction shown in FIG. 4.

In the embodiment of FIG. 7, each arm 56 of the endpiece is—in the same way as that shown in FIGS. 5 and 6—provided with a hinge pin 57 which is supported in a bearing housing 60. The side edges 67, 68 of the trapezoidal recess are, however, in this case extended upwards, as indicated at 69 and 70, and are provided there with apertures through which passes a wedge 71, which engages with the upper face or base face 72 of the trapezoidal bearing housing 60.

In the embodiment of FIGS. 8 and 9, the arms 73 of the endpiece is provided with a hinge pin 74 which is fixed therein and can be attached by means of welding. The connection piece has a fixed part 75 with a bearing shell 76, and pivotally attached at 77 to this fixed part 75 in a bearing cap 78, which can close the hinge pin 74. This closed position of the bearing can then be secured with a ring 79 and a wedge 80.

In the embodiment of FIGS. 10 to 12, the hinge pin 81 is fixed in such a way in the arm 82 of the endpiece that this pin is secured in the axial direction, for example by means of the plate 83, which engages with the groove 84 of the hinge pin 81. This securing can be such that the pin can turn in relation to the arm 82, but it can also be such that the pin is fixed. The connection piece has an arm 85 which is divided according to the line 86, in order to permit positioning of a fork 87 which is situated in a cylindrical recess and has a leg 88. The parts 89 and 90 of the connection piece part 85 form a groove 91, which is open at the top and in which the hinge pin can be placed when the fork is in the position shown in FIG. 11 or 12. When this positioning has taken place, the fork can be swung upwards, thus closing the hinge pin. This fork can then be secured in the closed position by means of a bolt or pin, which passes through apertures 92 and 93.

This seemingly complicated embodiment makes it possible to close the hinge pin without clearance if a distance is also created between the centre line of the bearing face in the parts 89 and 90 and the centre line of the cylindrical recess 94 in which the fork is supported.

With the embodiment of FIGS. 13 and 14, the hinge pin 95 is rotatably mounted both in the endpiece section 96 and in the connection part 97. The hinge pin can be removed in the axial direction if the securing device, consisting of the wedge 98, is removed. This wedge projects into a recess 99 of the pin and is closed between faces 100, 101 and 102 of the connection piece 99.

FIG. 15 is a schematic embodient in which the connection section 103 has a hinge pin 104 on which an arm 105 is swivellably mounted in a non-detachable fashion. The endpiece has a sleeve-shaped part 106 which grips the arm 105 and is fixed by means of a clamping wedge 107 or the like.

FIGS. 16 and 17 show the variant in which the arm 105 with a trapezoidal part 108 engages with a trapezoidal recess 109 of an endpiece arm 110 and is secured therein by means of a wedge 111 in the same way as that shown in FIG. 7.

In all schematic embodiments according to FIGS. 5 to 17, the detachable connection construction is present on either side of the trailing head.

We claim:

1. A suction pipe for a trailing suction dredger, comprising a suction tube having at its lower end a flange, a connection piece having a flange connected to the flange of the suction tube, the connection piece having an inner cross section which gradually changes from circular at its flange into rectangular at its other end, a trailing head on said other end of the connection piece, the connection piece having bearing housings thereon, two transversely extending horizontal shafts each of which partly extends into the trailing head and partly into said bearing housings, and detachable couplings removably interconnecting said bearing housings with the connection piece, said connection piece having recesses which are open at the top and closed at the bottom and are disposed on either side of a lower portion of said other end of the connection piece, said recesses having guide surfaces which slidably receive said bearing housings, and said couplings releasably securing the bearing housings in said recesses.

2. Suction pipe as claimed in claim 1, said couplings comprising wedges which fit between upwardly extending surfaces of the bearing housings and grooves in said recesses.

3. A suction pipe for a trailing suction dredger, comprising a suction tube having at its lower end a flange, a connection piece having a flange connected to the flange of the suction tube, the connection piece having an inner cross section which gradually changes from circular at its flange into rectangular at its other end, a trailing head on said other end of the connection piece, the connection piece having bearing housings thereon, two transversely extending horizontal shafts each of which partly extends into the trailing head and partly into said bearing housings, and detachable couplings removably interconnecting said bearing housings with the connection piece, said trailing head having a cylindrically curved upwardly concave upper surface which coacts with a flexible sealing strip attached to the connection piece, the flexible sealing strip being secured to a transversely extending pivot shaft on the upper side of the connection piece, said strip being free to swing outwardly from its position of engagement with said curved surface toward a position in which it is out of the path of movement of the bearing housings, said bearing housings supporting the trailing head for vertical swinging movement relative to the connection piece.

4. A suction pipe for a trailing suction dredger, comprising a suction tube having at its lower end a flange, a connection piece having a flange connected to the flange of the suction tube, the connection piece having an inner cross section which gradually changes from circular at its flange into rectangular at its other end, a trailing head on said other end of the connection piece, the connection piece having bearing housings thereon, two transversely extending horizontal shafts each of which partly extends into the trailing head and partly into said bearing housings, and detachable couplings removably interconnecting said bearing housings with the connection piece, said connection piece having, below the lower edge of said other end thereof, a removable tool carrier which extends transversely across the width of the trailing head, the tool carrier having plural individual coupling means for separate tools, said coupling means for separate tools comprising a trapezoidal wedge plate insertable in the spaces between two guides extending downwardly toward each other, said guides having flanged edges extending toward each other to grip the trapezoidal plate of a tool, said wedge plates being secured to a downwardly extending rear surface of the tool carrier.

5. A suction pipe for a trailing suction dredger, comprising a suction tube having at its lower end a flange, a connection piece having a flange connected to the flange of the suction tube, the connection piece having an inner cross section which gradually changes from circular at its flange into rectangular at its other end, a trailing head on said other end of the connection piece, the connection piece having bearing housings thereon, two transversely extending horizontal shafts each of which partly extends into the trailing head and partly into said bearing housings, detachable couplings removably interconnecting said bearing housings with the connection piece, said connection piece having, below the lower edge of said other end thereof, a removable tool carrier which extends transversely across the width of the trailing head, the tool carrier having plural individual coupling means for separate tools, and a heel piece on the underside of the connection piece, the tool carrier forming the rear wall of a water tank which is connected to a pressure water pipe and is located between the heel piece and the lower wall of the connection piece, said tool carrier having spray nozzles which are connected to the water tank.

6. A suction pipe for a trailing suction dredger, comprising a suction tube having at its lower end a flange, a connection piece having a flange connected to the flange of the suction tube, the connection piece having an inner cross section which gradually changes from circular at its flange into rectangular at its other end, a trailing head on said other end of the connection piece, the connection piece having bearing housings thereon, two transversely extending horizontal shafts each of which partly extends into the trailing head and partly into said bearing housings, detachable couplings removably interconnecting said bearing housings with the connection piece, and a pressure water pipe extending through a central face of the connection piece, and current-deflecting plates secured on either side of the pressure water pipe in the interior of the connection piece.

* * * * *